US008104502B2

(12) United States Patent
Nakata et al.

(10) Patent No.: US 8,104,502 B2
(45) Date of Patent: Jan. 31, 2012

(54) DRAIN WATER BACTERIOSTATIC STRUCTURE FOR AIR CONDITIONER

(75) Inventors: Haruo Nakata, Sakai (JP); Makio Takeuchi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1105 days.

(21) Appl. No.: 11/791,733

(22) PCT Filed: Dec. 13, 2005

(86) PCT No.: PCT/JP2005/022888

§ 371 (c)(1), (2), (4) Date: May 25, 2007

(87) PCT Pub. No.: WO2006/064812

PCT Pub. Date: Jun. 22, 2006

(65) Prior Publication Data

US 2011/0126917 A1 Jun. 2, 2011

(30) Foreign Application Priority Data

Dec. 13, 2004 (JP) ..... 2004-360316

(51) Int. Cl.
*F24F 13/00* (2006.01)
*F16K 23/00* (2006.01)

(52) U.S. Cl. ..... 137/312; 137/268; 220/571

(58) Field of Classification Search ..... 137/268, 137/312; 220/571; 422/264, 276, 277
See application file for complete search history.

(56) References Cited

U.S. PATENT DOCUMENTS

| | | | | |
|---|---|---|---|---|
| 3,990,855 | A | 11/1976 | Cort et al. | |
| 4,869,075 | A * | 9/1989 | Ikari et al. | 62/280 |
| 5,514,344 | A | 5/1996 | D'Agaro | |
| 5,976,364 | A | 11/1999 | Williams | |
| 7,392,821 | B2 * | 7/2008 | Nakata et al. | 137/312 |

FOREIGN PATENT DOCUMENTS

| | | | |
|---|---|---|---|
| JP | 63-73039 | A | 4/1988 |
| JP | 2-106630 | A | 4/1990 |
| JP | 5-9692 | U | 2/1993 |
| JP | 10-78240 | A | 3/1998 |
| JP | 2000-97447 | A | 4/2000 |
| JP | 2002-257400 | A | 9/2002 |
| JP | 2004-149585 | A | 5/2004 |

* cited by examiner

*Primary Examiner* — Kevin Lee
(74) *Attorney, Agent, or Firm* — Birch, Stewart, Kolasch & Birch, LLP

(57) ABSTRACT

A drain water bacteriostatic structure for an air conditioner is provided with a drain pan 8 for holding drain water generated in an air conditioner 1 and an upright antibacterial member 50 which is provided in the drain pan 8. The antibacterial member 50 is provided with an antibacterial agent 50B. The length $L_3$ of the antibacterial member 50 in the up-down direction is set such that the lower end portion 50*a* of the antibacterial member 50 is immersed in drain water when the drain water is at the minimum water level $L_1$ in the drain pan 8, and the upper end portion 50*b* of the antibacterial member 50 is exposed above the maximum water level $L_2$ of drain water in the drain pan 8 by a predetermined length H or more.

4 Claims, 18 Drawing Sheets

Fig.22
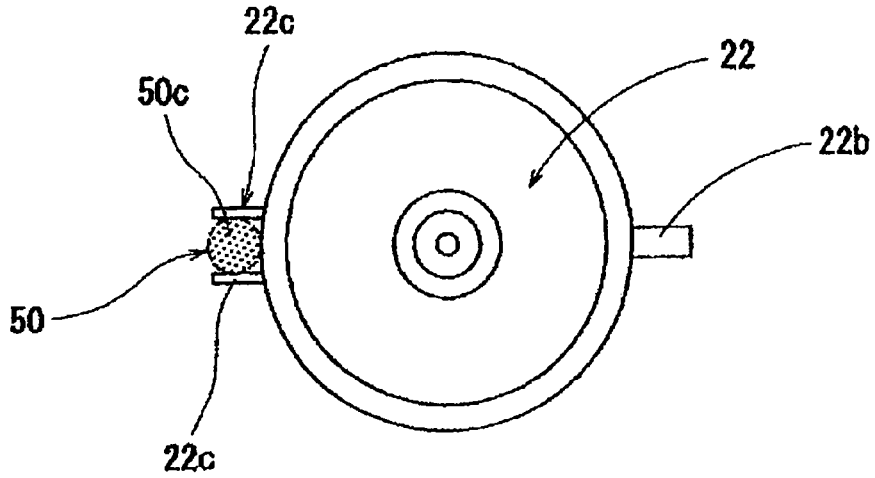
Fig.23(a)
<Initial Stage>
Fig.23(b)
<After predetermined period of time has elapsed>
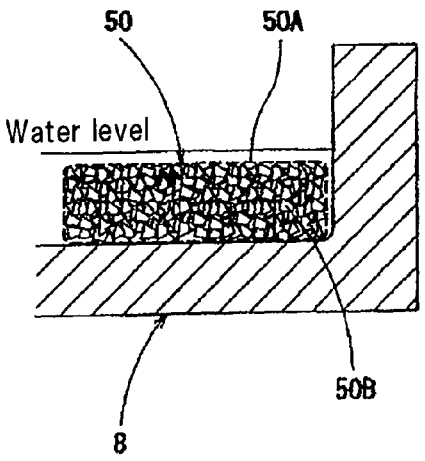
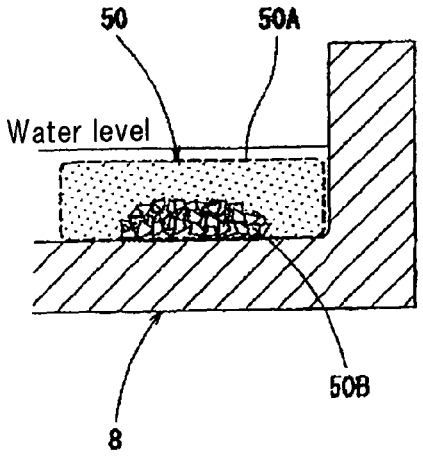

DRAIN WATER BACTERIOSTATIC STRUCTURE FOR AIR CONDITIONER

TECHNICAL FIELD

The present invention relates to a structure for a drain water bacteriostatic unit of an air conditioner.

BACKGROUND ART

A drain pan for receiving and discharging drain water to the outside is provided in the lower portion of heat exchangers in general-purpose air conditioners.

Drain water held in a drain pan is discharged to the outside through a drain pipe from an inclined trench provided in the drain pan in the case of window type and wall type air conditioners, and through a drain pipe after being pumped up by a drain pump (including drain up kits) in the case of ceiling embedded-type and ceiling suspended air conditioners.

In either case, however, drain water stays in the drain pan for a predetermined period of time. Therefore, bacteria can multiply in the drain water in the drain pan, and odor and clogging of the drain pipe due to generation of slime become a problem.

As a measure against this, a technology for layering an antibacterial agent-containing resin composite layer and a sheet or a film made of a resin on the inner wall surface of the drain pan in sequence has already been proposed (see Japanese Laid-Open Patent Publication No. 10-78240). The antibacterial agent-containing resin composite layer contains crystal polypropylene, an inorganic filler and an antibacterial agent. Thus, according to this technology, the antibacterial agent transmits through the sheet or the film made of a resin and acts on the drain water, and therefore, bacteria are prevented from multiplying in the drain water.

In addition, a technology for pasting a copper alloy foil having pasteurizing effects on the bottom of the drain pan has also been proposed (Japanese Laid-Open Patent Publication No. 2-106630). Furthermore, a technology for mixing a pasteurizing agent in the material that forms the drain pan and irradiating the drain water with ultraviolet rays from an ultraviolet ray lamp has also been proposed (Japanese Laid-Open Patent Publication No. 2000-97447).

In any of the above described technologies, however, a problem arises in that the structure of the drain pan becomes complicated, and the bacteriostatic effects gradually decrease together with contamination, for example, through generation of slime.

Furthermore, in the case of the technology disclosed in Japanese Laid-Open Patent Publication No. 2000-97447, the configuration of some air conditioners makes it difficult to uniformly irradiate the entirety of the drain pan with ultraviolet rays using a single ultraviolet ray lamp, and thus, a number of ultraviolet ray lamps are necessary. Therefore, there is a problem with this technology in that the cost for installing ultraviolet ray lamps and the operating costs both are high.

Under these circumstances, an antibacterial member 50, where a container 50A having a mesh structure is filled with an antibacterial agent 50B in granular form or pellet form, is generally used in such a state that the entirety is submerged in the drain water, as shown in FIGS. 23(*a*) and 23(*b*). The antibacterial agent 50B dissolves in the water and has pasteurizing effects. Water soluble glass carrying an inorganic antibacterial agent can be cited as a concrete example of the antibacterial agent 50B. In the case of this bacteriostatic structure, the antibacterial member 50 is replaced with a new antibacterial member 50 when the antibacterial agent 50B in the container 50A has been used up, after a certain period of time.

The antibacterial agent 50B has the minimum level of concentration required for gaining bacteriostatic effects. This minimum concentration differs depending on the type of antibacterial agent 50B used. Therefore, the initial amount (immersed amount) of the antibacterial agent is determined so that this minimum concentration can be ensured under the worst conditions (conditions that minimize the concentration of the eluted antibacterial agent) within the range of conditions for conventional use, and stable and effective bacteriostatic effects can be gained over the years that the antibacterial agent is used.

FIG. 24 shows the relationship between the years (time) of use of the antibacterial agent 50B and the concentration of the antibacterial agent 50B in drain water. As the years of use increases, the antibacterial agent 50B depletes, and the concentration of the antibacterial agent 50B lowers (see A-B in FIG. 24). Accordingly, a large amount of antibacterial agent is necessary, in order to have bacteriostatic effects over N years, because the initial amount of antibacterial agent must be the sum of the amount of antibacterial agent which ensures the minimum concentration required after N years and the amount of antibacterial agent depleted over N years.

When all of the antibacterial agent of the amount determined in this manner is used in such a state as to be submerged in drain water, as shown in FIG. 23(*a*), the amount of eluted antibacterial agent 50B is high, and thus, effective bacteriostatic effects are gained, but the concentration of the antibacterial agent is higher than required, and the antibacterial agent is consumed in a wasteful manner.

In addition, though in the case where the period of use is short, only just the sufficient amount of antibacterial agent for ensuring the minimum concentration is required, it is necessary to increase the amount of antibacterial agent by such an amount that bacteriostatic effects can be gained over a long period of time (for example several years to a dozen or so years). In this case, the above described initial concentration is much greater than the above described minimum concentration required, and a problem arises that the antibacterial agent is consumed in a wasteful manner.

DISCLOSURE OF THE INVENTION

Problem to be Solved by the Invention

The present invention is provided in order to solve the above described problems, and an objective thereof is to provide a drain water bacteriostatic structure for an air conditioner where an antibacterial agent is eluted by a necessary amount at necessary times, so that the concentration of the antibacterial agent is always kept constant, and thus, stable and efficient bacteriostatic effects are sustained over a long period of time.

Means for Solving Problem

One embodiment for solving the above described problems according to the present invention provides a drain water bacteriostatic structure for an air conditioner having a drain pan 8 for holding drain water generated in an air conditioner 1, and an upright antibacterial member 50 which is installed inside the drain pan 8. The antibacterial member 50 has an antibacterial agent 50B. The length $L_3$ of the antibacterial member 50 in the up-down direction is set such that the lower end portion 50*a* of the antibacterial member 50 is submerged in drain water when the drain water in the drain pan 8 is at the minimum water level $L_1$, and the upper end portion 50*b* of the antibacterial member 50 is exposed above the maximum water level $L_2$ of the drain water within the drain pan 8 by a predetermined length H or more.

In the above described configuration, when the antibacterial agent 50B, which is submerged in drain water in the lower end portion 50*a* of the antibacterial member 50, is eluted in the drain water and gradually reduced, new antibacterial agent 50B, which is located above the actual water level of the drain water and not eluted, moves down from above in response so as to be supplied in sequence.

Accordingly, the predetermined length H is set to an appropriate length, taking the consumed amount into consideration in accordance with the water level, and thus, continuous use with a constant concentration is possible over a desired long period of time. In addition, this configuration can be gained by modifying only the configuration of the antibacterial member 50 with the configuration of the drain pan 8 left as it is in the prior art, and therefore, the drain water bacteriostatic structure is simple and inexpensive.

It is preferable for the above described antibacterial member 50 to be formed of a container 50A having a number of pores and an antibacterial agent 50B in granular form or pellet form contained within the container 50A. In this case, the antibacterial agent 50B in granular form or pellet form is eluted out from the antibacterial member 50 through the pores of the container 50A, and thus, pasteurizing effects are gained. Furthermore, the space created as a result of elution of the antibacterial agent 50B is supplied with a new antibacterial agent 50B located above, and lowers smoothly as a result of gravity.

At this time, it is preferable for the air conditioner 1 to have a drain pump 22 and for the antibacterial member 50 to be provided in a portion where the drain pump 22 is installed. In this case, microscopic vibration when the drain pump 22 is driven allows new antibacterial agent 50B to be supplied smoothly into the above described space from above, and thus, more stable supply of antibacterial agent 50B is possible.

In general, the above described antibacterial agent in granular form or pellet form is placed at random, and therefore, this configuration provides excellent effects for supplying the antibacterial agent 50B smoothly into the above described space from above. Furthermore, the portion where the drain pump 22 is installed is originally designated as maintenance space, and therefore, the antibacterial member 50 can be easily replaced after years of use.

In addition, it is preferable for the above described antibacterial member 50 to be formed of an antibacterial agent holding material 50D having water soluble properties and an antibacterial agent 50B in granular form or pellet form which is mixed in with the holding material 50D. In this case, as the antibacterial agent holding material 50D dissolves, the antibacterial agent 50B in granular form or pellet form is eluted, so that pasteurizing effects are gained. Furthermore, as the antibacterial agent holding material 50D dissolves, the antibacterial member 50 sinks smoothly as a whole as a result of gravity. Therefore, the pasteurizing effects are always sustained in a stable state.

BRIEF DESCRIPTION OF THE DRAWINGS

FIG. 22 is an enlarged plan view showing the drain water bacteriostatic structure for an air conditioner;

FIG. 23(*a*) is a cross-sectional view showing the initial state of an antibacterial member in a prior art drain water bacteriostatic structure, and FIG. 23(*b*) is a cross-sectional view showing the antibacterial member after a predetermined period of time has elapsed.

BEST MODE FOR CARRYING OUT THE INVENTION

First Embodiment

In the following, a drain water bacteriostatic structure for an air conditioner according to a first embodiment of the present invention is described.

Figure 1:
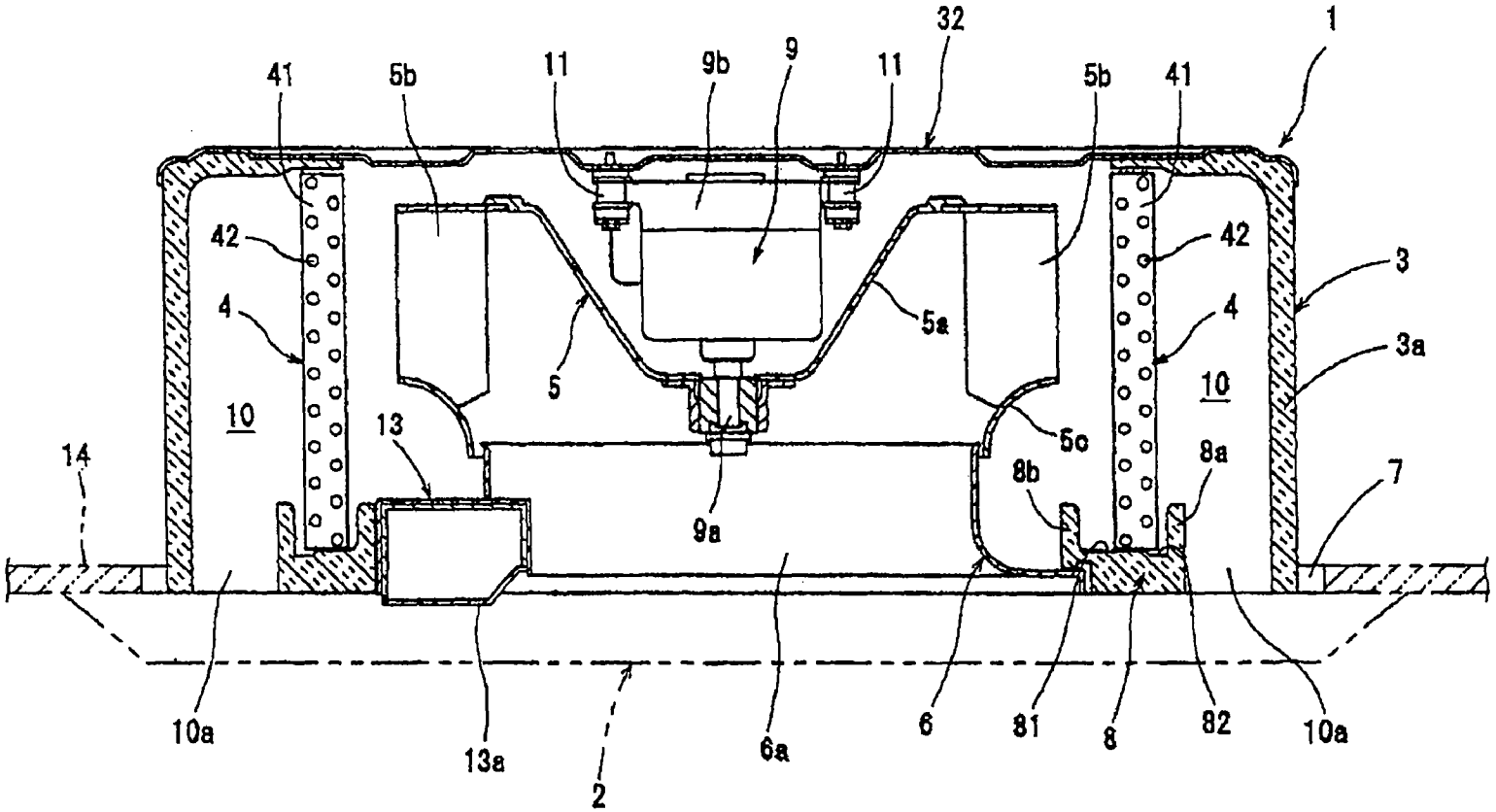
FIG. 1 is a cross-sectional view showing an air conditioner according to embodiments to which a drain water bacteriostatic structure of the present invention is applied.
Figure 2:
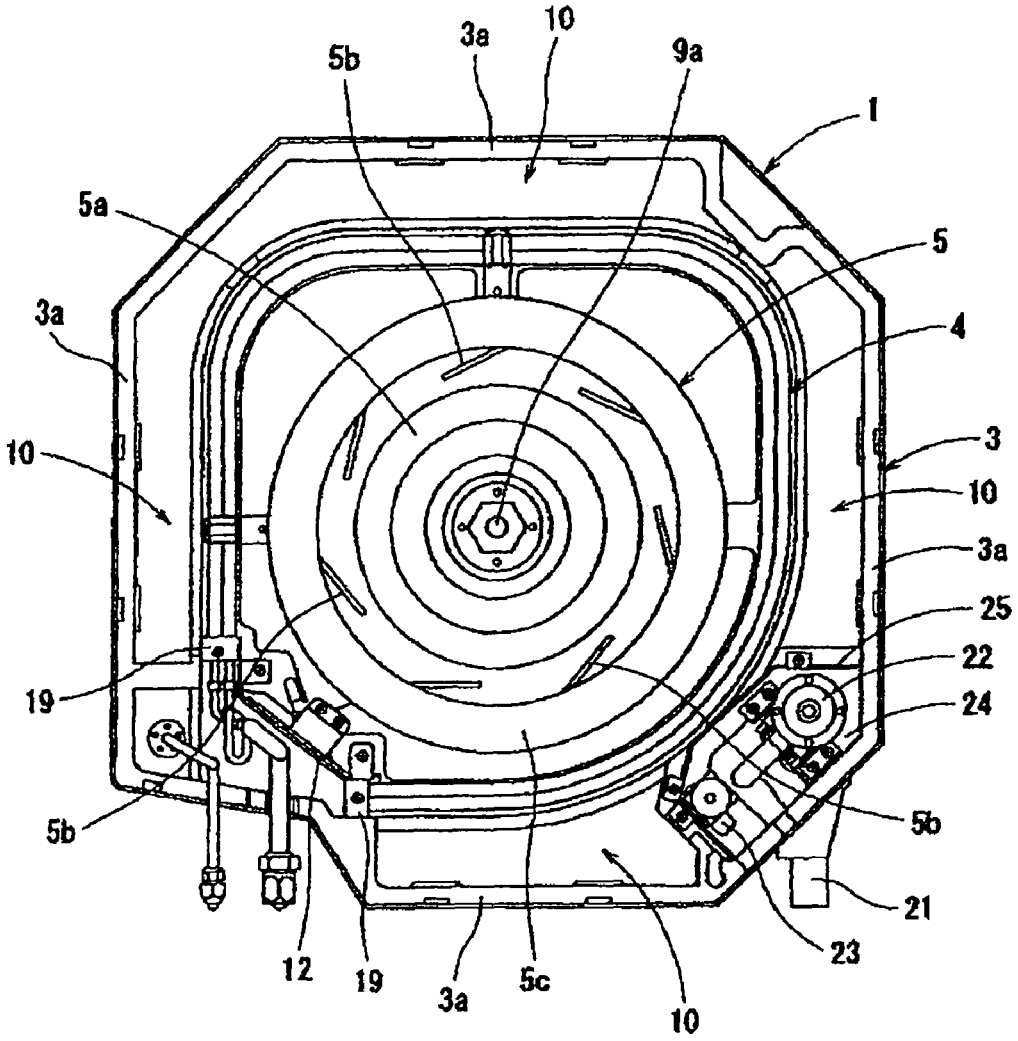
FIG. 2 is a bottom view showing the air conditioner.

First, FIGS. 1 and 2 show an example of a structure for an air conditioner to which the present invention is applicable.

As shown in FIGS. 1 and 2, this air conditioner has an air conditioner main body 1 which is provided above an opening 7 created in a ceiling 14, and a face panel 2 for covering the opening 7, together with the air conditioner main body 1. The air conditioner main body 1 has a cassette type main body casing 3 in approximately hexagonal form, and a heat exchanger 4 in approximately annular form, a fan (radial impeller) 5, which is placed at the center of the heat exchanger 4 and of which the intake side faces downward and the side from which air is blown out faces the inner peripheral surface of the heat exchanger 4, and fan motor 9, and a bell mouth 6 (opening for air intake 6*a*), which is placed on the intake side of the fan 5, are provided within the main body casing 3.

The fan 5 is formed of a radial fan having a number of blades 5*b* between a hub 5*a* which is located on top and a shroud 5*c* which is located beneath, and the center axis portion of the hub 5*a* is secured to the motor shaft 9*a* of the above described fan motor 9, and thus, the fan 5 is supported in such a manner as to be rotatable in a horizontal plane. A bracket 9*b* for attaching the fan motor is attached to the top plate 32 of the main body casing 3 using a number of fan motor mounting members 11, and thus, the fan motor 9 is supported by the top plate 32.

A drain pan 8 having a form corresponding to the form of the heat exchanger 4 is placed beneath the heat exchanger 4. An air outlet passage 10 is formed in the outer periphery outside the heat exchanger 4, and an opening for blowing out air 10*a* is created downstream from the air outlet passage 10.

The cassette type main body casing 3 is formed of a side wall 3*a* made of a heat insulating material and the above described top plate 32, which covers the upper portion of the side wall 3*a*.

The heat exchanger 4 is formed so as to be of a cross fin coil type having a number of heat transfer pipes 42 and a number of plate fins 41. Each heat transfer pipe 42 is placed so as to extend in the horizontal direction and bent into approximately annular form, and thus, two columns of heat conductive pipes which extend parallel to each other are formed. Each plate fin 41 is placed so as to cross each heat transfer pipe 42. A pipe plate is provided at the two respective opening ends of the heat exchanger 4, and the respective pipe plates are linked through a predetermined partitioning plate 12.

The top plate 32 of the main body casing 3, the respective pipe plates, the partitioning plate 12 and the switch box 13, which is attached on the lower surface of the bell mouth 6, are all formed of a plate metal product. In addition, the top plate 32 and the switch box 13 are secured at the two ends, upper and lower, of the partitioning plate 12 with screws.

A recess 14 for accommodating the switch box 13 is created on one side of the above described bell mouth 6, and the switch box 13 is engaged in the recess 14.

A pair of attachment pieces 19, which are portions linked at the lower end of the respective pipe plates are formed integrally with the partitioning plate 12 at the lower end of the partitioning plate 12. The respective attachment pieces 19 are secured to the pipe plates with screws from beneath.

The air conditioner further has a drain hose connecting opening 21 which runs out from the building, a drain pump 22, which is placed in a drain pump accommodating portion 24, and a float switch 23. The drain pump accommodating portion 24 is partitioned by a partitioning plate 13*a*. The switch box 13 is covered with a lid cover.

(Structure for Installing Drain Pan and Antibacterial Member)

Figure 3:
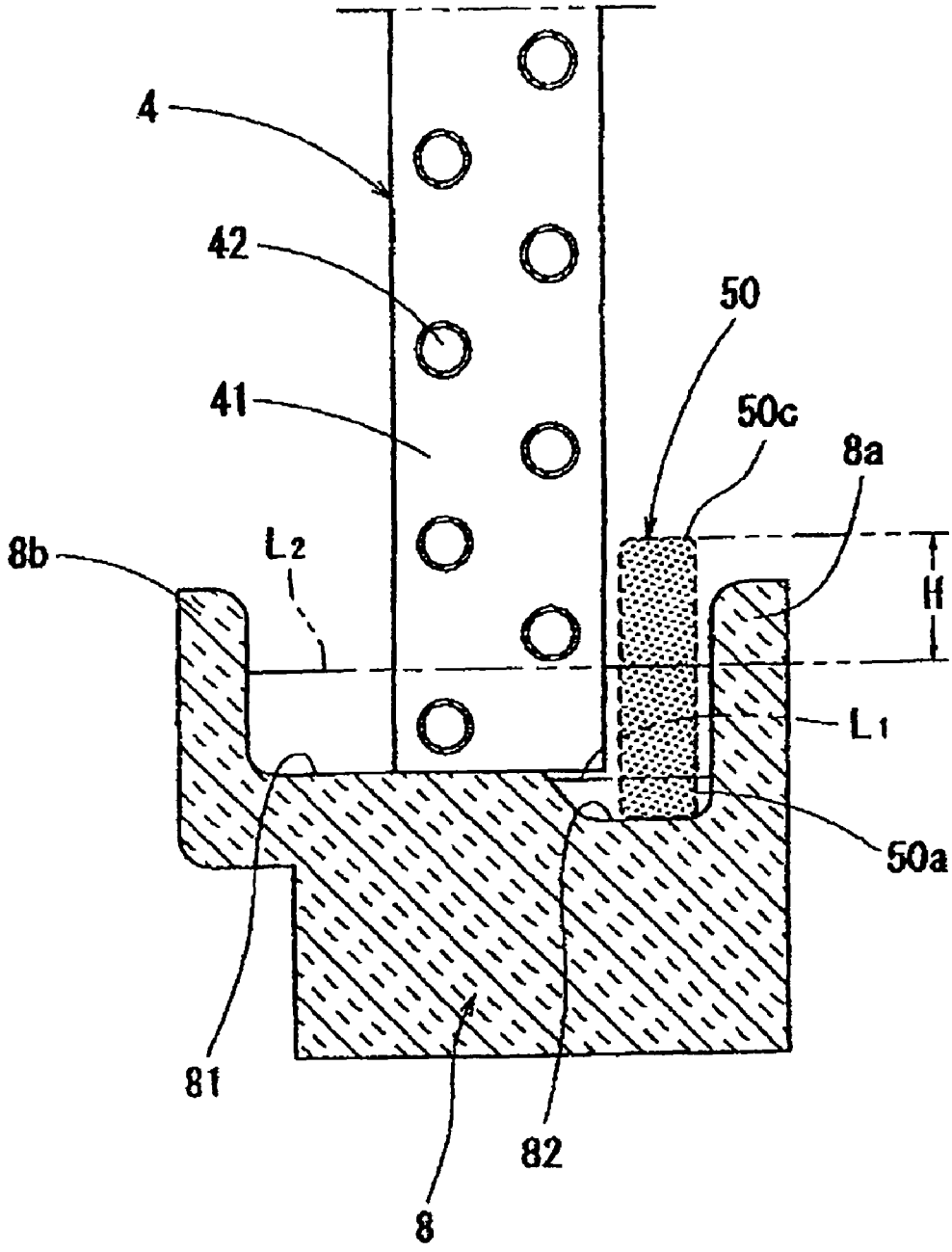
FIG. 3 is a cross-sectional view showing a drain water bacteriostatic structure of an air conditioner according to the first embodiment.

The above described drain pan 8 is formed as shown in FIG. 3. That is to say, the entirety of the drain pan 8 is formed from predetermined heat insulating material in approximately annular form. Two trenches; a first trench 81 in which the respective plate fins 41 of the heat exchanger 4 are placed and a second trench 82 for discharging drain water which is deeper than the first trench 81, are provided on the upper surface of the drain pan 8, between a side wall 8*a*, which is located on the outer periphery side, and a side wall 8*b*, which is located on the inner periphery side.

In addition, an antibacterial member 50 is installed within the second trench 82 in an upright state. This antibacterial member 50 has an antibacterial agent 50B (see FIG. 6), so that the antibacterial agent 50B (see FIG. 6) works on drain water held in the first trench 81 and the second trench 82 (including flowing water), and bacteriostasis takes place in the drain water.

Figure 4:
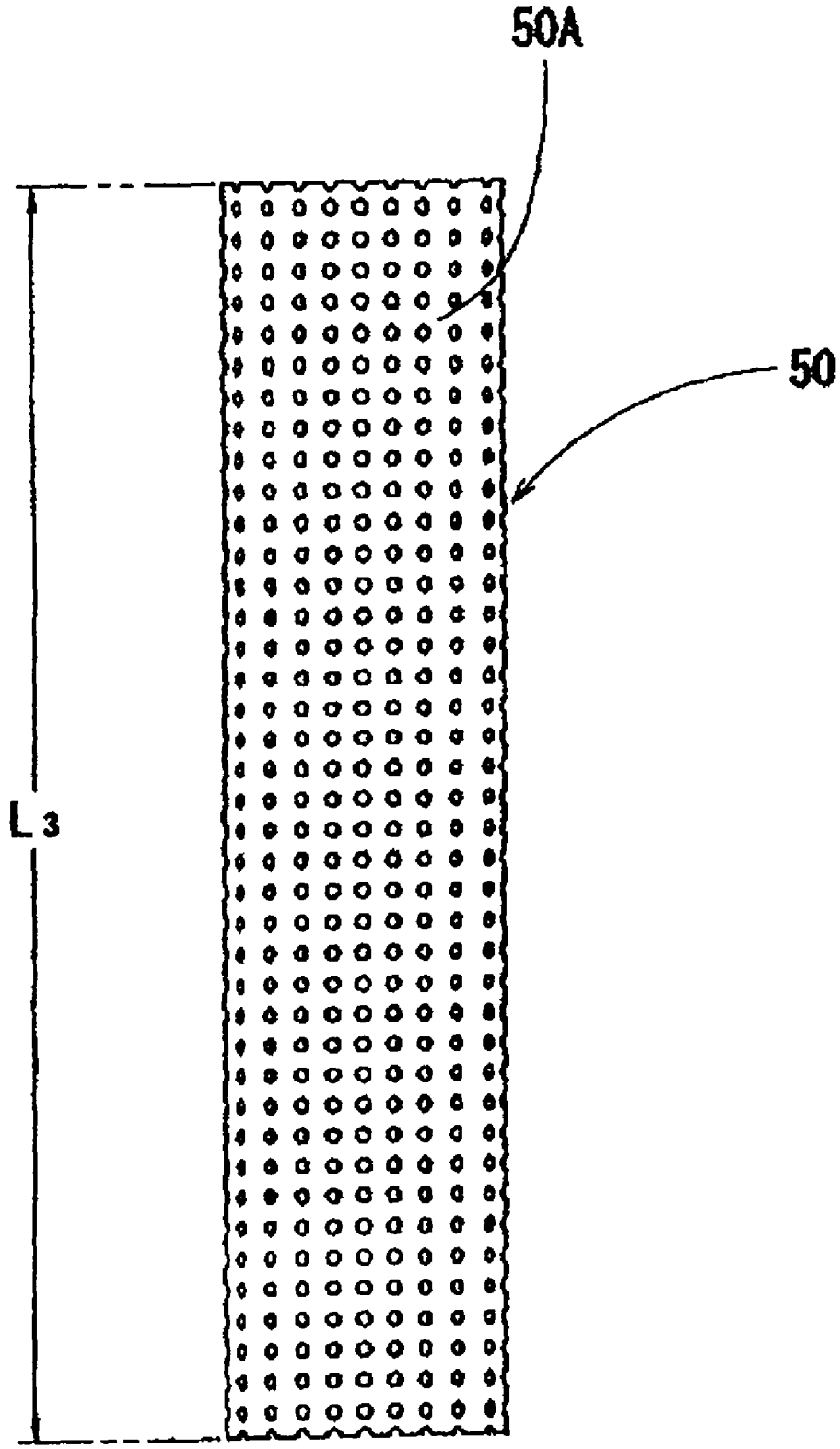
FIG. 4 is an enlarged front view showing an antibacterial member.
Figure 5:
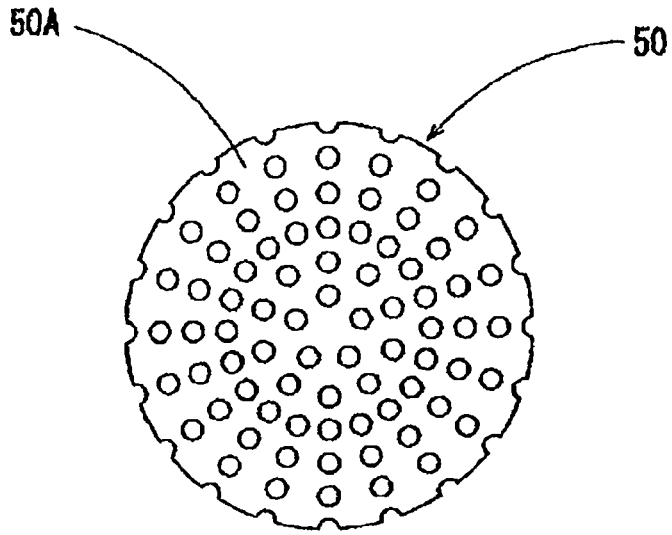
FIG. 5 is a plan view showing the antibacterial member.
Figure 6:
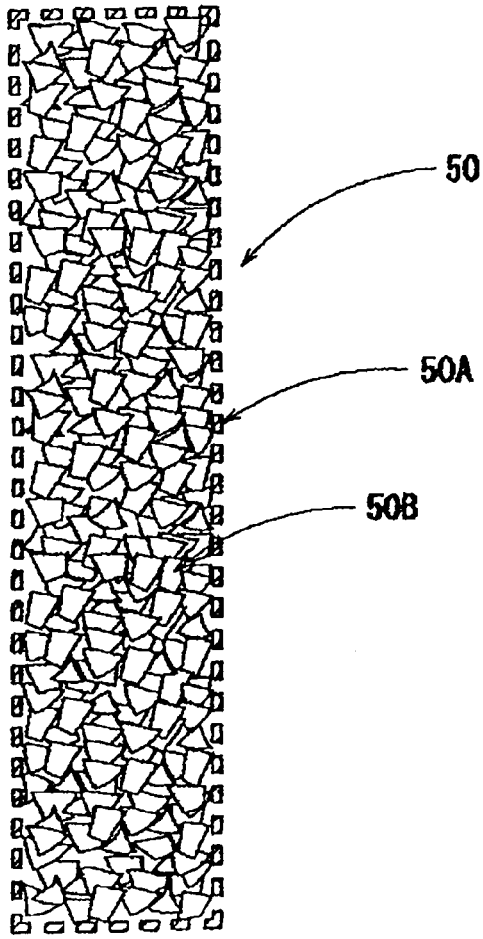
FIG. 6 is an enlarged cross-sectional view showing the antibacterial member.

This antibacterial member 50 is formed of a container main body 50A in cylindrical form which extends over a predetermined length $L_3$ in the up-down direction and an antibacterial agent 50B in granular form or pellet form which is contained in such a state that the container main body 50A is approximately filled to the fullest, as shown in FIGS. 4 to 6. The two ends, upper and lower, of the container main body 50A are closed, and a number of pores are created in the walls of the container main body 50A. The antibacterial member 50 is supported on the bottom of the second trench 82, so that the lower end portion 50*a* of the antibacterial member 50 is submerged in drain water when the water level of the drain water in the first and second trenches 81 and 82 is at the minimum, that is to say, drain water is at the minimum water level $L_1$. The predetermined length $L_3$ is set such that the upper end portion 50*c* of the antibacterial member 50 is exposed above the maximum water level $L_2$ of the drain water by a predetermined length H or more when the antibacterial member 50 is installed on the bottom of the second trench 82 and the water level of drain water in the above described first and second trenches 81 and 82 is the expected maximum level, that is to say, drain water is at the maximum water level $L_2$, as shown in FIG. 3.

The antibacterial agent 50B has such properties as to dissolve in water, and thus, dissolves in accordance with the amount of drain water (immersed amount) in the first and second trenches 81 and 82 of the above described drain pan 8 so as to elute out through the pores in the walls of the container main body 50A and pasteurize the drain water.

Figure 24:
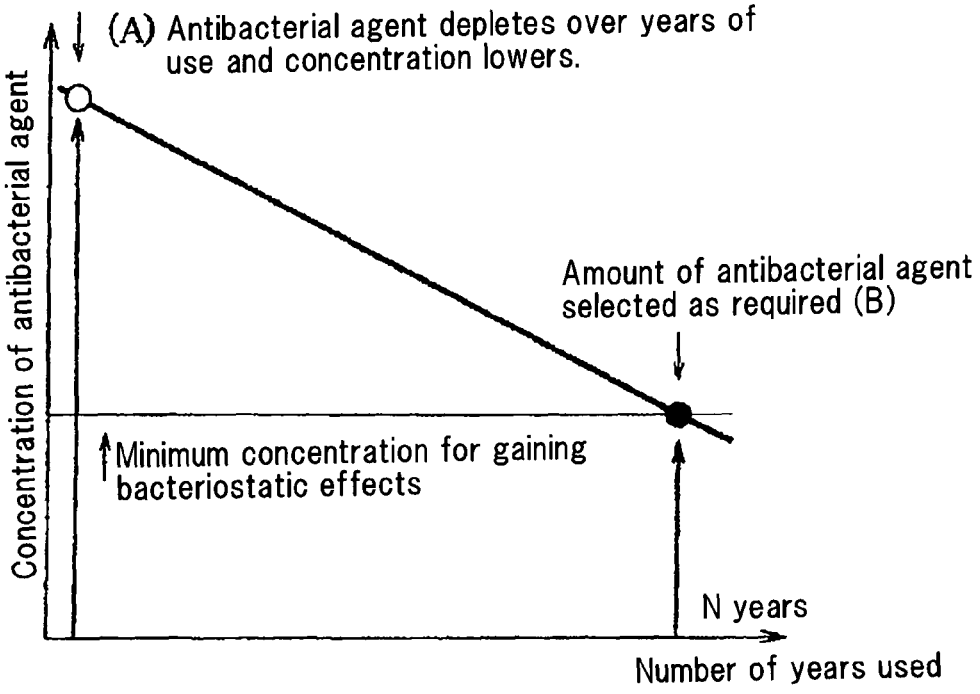
FIG. 24 is a graph illustrating the problem with the prior art drain water bacteriostatic structure for an air conditioner, in terms of the antibacterial effects.

In the case where such bacteriostatic effects are gained, as described above, the antibacterial agent 50B has the minimum concentration required for gaining effective bacteriostatic effects. This minimum concentration differs depending on the type of antibacterial agent 50B used. Therefore, the initial amount (immersed amount) of the antibacterial agent is usually determined in such a manner that the above described minimum concentration can be ensured under the worst conditions within the range of conditions for use (conditions which make the concentration of the eluted antibacterial agent the lowest), and in addition, stable, effective bacteriostatic effects can be gained over years of use (N years), as shown in FIG. 24.

When all of the antibacterial agent of the amount determined in this manner is used in such a state as to be immersed in drain water, as in the prior art (FIG. 23), effective bacteriostatic effects are gained under the worst conditions, as well as under other conditions, but the concentration of the antibacterial agent is higher than necessary under other conditions, and the antibacterial agent is consumed in a wasteful manner.

In addition, though in the case where the period of use is short, only just the sufficient amount of antibacterial agent for ensuring the minimum concentration is required, it is necessary to increase the amount of antibacterial agent by such an amount that bacteriostatic effects can be gained over a long period of time (for example several years to a dozen or so years). At this time, the initial concentration of the antibacterial agent in drain water is much greater than the minimum concentration required, and therefore, the antibacterial agent is consumed in a wasteful manner.

In the configuration according to the present embodiment, however, the antibacterial member 50 having the predetermined length $L_3$ is formed in the drain pan 8 in the air conditioner, as described above. Furthermore, the lower end portion 50*a* of the antibacterial member 50 is submerged in drain water when the drain water is at the minimum water level $L_1$, and the upper end portion 50*c* of the antibacterial member 50 is higher than the maximum water level $L_2$ of the drain water by a predetermined length H or more.

Figure 7A:
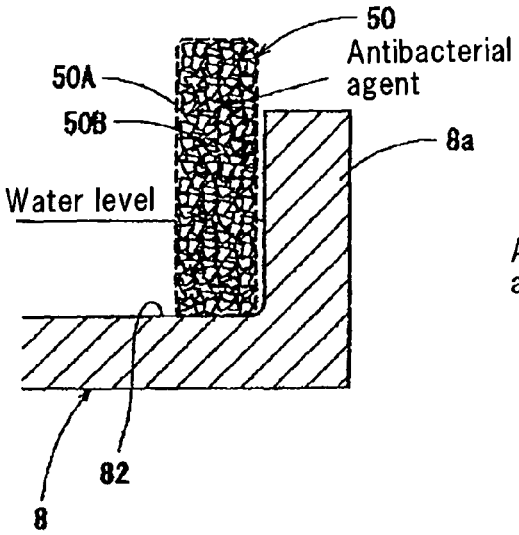
FIG. 7(*a*) is a cross-sectional view showing the initial state of the antibacterial member, and FIG. 7(*b*) is a cross-sectional view showing the antibacterial member after a predetermined period of time has elapsed.
Figure 7B:
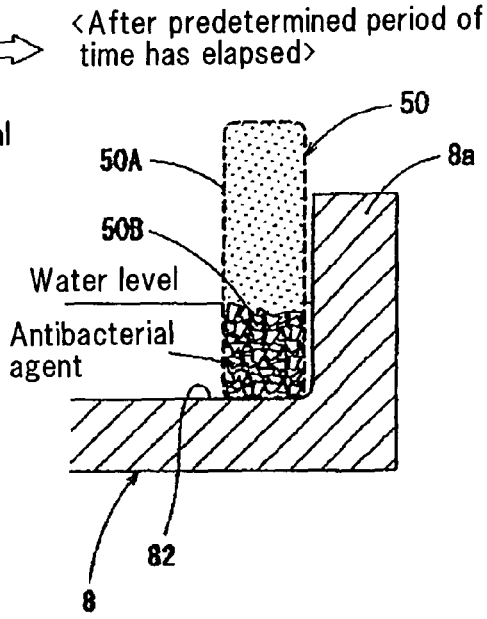

In this configuration, even when the antibacterial agent 50B which is submerged in drain water is eluted (dissolves) in the drain water and gradually depletes in the lower end portion 50*a* of the antibacterial member 50 in the initial state shown in FIG. 7(*a*), new antibacterial agent 50B, which is located above the actual water level of the above described drain water and not at all diluted, as shown in FIG. 7(*b*), gradually moves down from above in response as a result of gravity, so as to be supplied in sequence.

Accordingly, when the predetermined length H is set to an appropriate length in accordance with the years of use, taking the amount of depletion into consideration in accordance with the water level, as shown in FIG. 7(*b*), continuous use of the antibacterial member 50 over a desired long period of time until the antibacterial agent 50B at the top is depleted is possible. In addition, in this configuration, it is possible to modify only the configuration of the antibacterial member 50, and the configuration of the drain pan 8 can be left as it is in the prior art, and thus, the drain water bacteriostatic structure is simple and inexpensive.

In particular, according to the present embodiment, the above described antibacterial member 50 is formed of a container main body 50A having a number of pores and an antibacterial agent 50B in granular form or pellet form which is contained in the container main body 50A, as shown in FIGS. 4 to 6.

Accordingly, the antibacterial agent 50B in granular form or pellet form is eluted out through the number of the pores in the container main body 50A, and in addition, the lower end portion 50*a* from which the antibacterial agent 50B has been eluted out is supplied from above with a new antibacterial agent 50B, which moves down smoothly as a result of gravity.

As a result of this, in the configuration according to the present embodiment, the antibacterial agent 50 can be prevented from depleting in a wasteful manner, and the life can be prolonged to the maximum with the antibacterial agent maintaining a constant and stable concentration, so as to work effectively, unlike conventional cases, where the entirety of the antibacterial member 50 is immersed.

That is to say, in this configuration, a necessary amount of the antibacterial agent 50B is eluted at necessary times, so that the concentration of the antibacterial agent 50B is always kept constant in the drain water, and stable, efficient bacteriostatic effects can be sustained over a long period of time.

Figure 8:
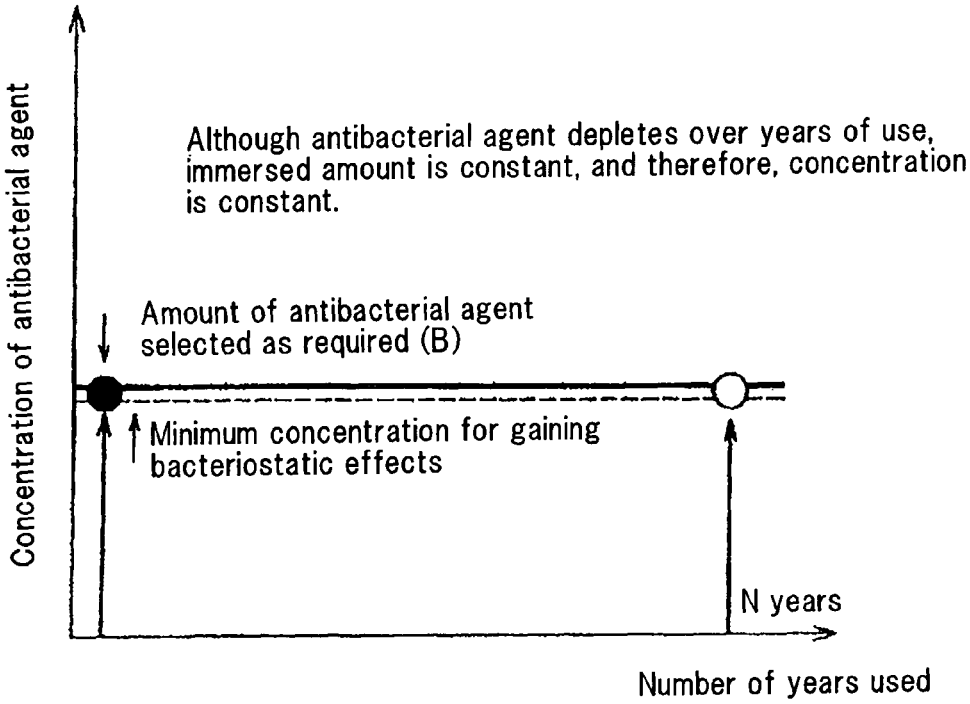
FIG. 8 is a graph showing the effects of the antibacterial member.

FIG. 8 shows the relationship between the years of use (time) N of the antibacterial agent 50B and the concentration of the antibacterial agent 50B in drain water when the antibacterial member 50 is installed in the state described above. In the case shown in FIG. 8 also, the antibacterial agent 50B depletes as the years of use elapse, the immersed amount of the antibacterial agent 50B is constant, unlike in the conventional cases shown in FIG. 24, and thus, the concentration of the antibacterial agent 50B in the drain water does not change. Accordingly, the amount of antibacterial agent which can ensure the minimum concentration required over N years is sufficient as an initial amount for antibacterial agent required for gaining bacteriostatic effects for N years, and therefore, the amount of antibacterial agent which depletes for the same N years is considerably reduced in comparison with the prior art.

First Modification

Figure 9:
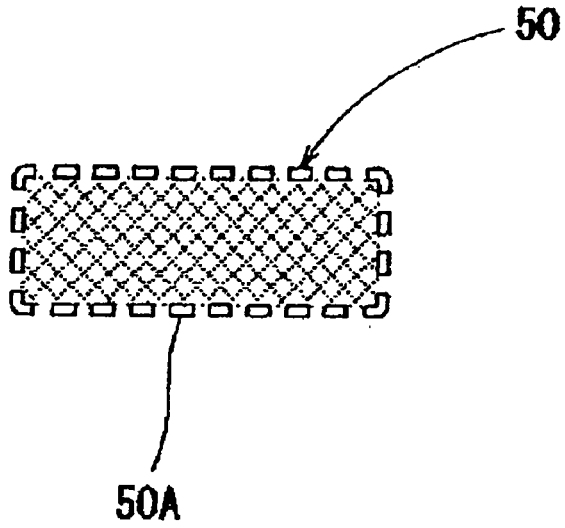
FIG. 9 is a plan view showing an antibacterial member according to a first modification.
Figure 10:
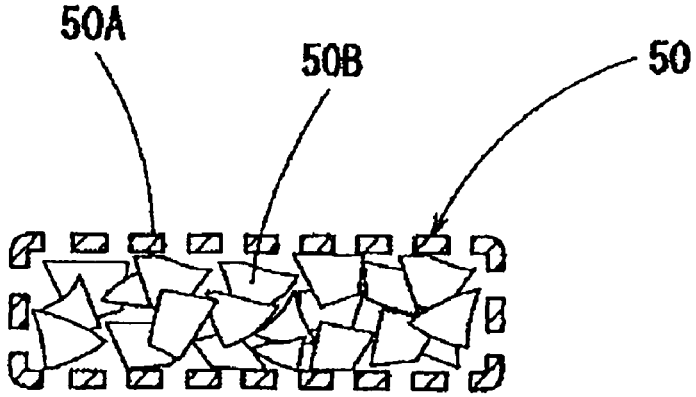
FIG. 10 is an enlarged cross-sectional view showing the antibacterial member.

A first modification is the same as the above described first embodiment, except that the form of the antibacterial member 50 is changed to a flat cylindrical form, as shown in FIGS. 9 and 10. In this configuration also, exactly the same advantages as in the above described first embodiment can be gained.

In addition, in this configuration, the antibacterial member 50 can be easily installed, even in the case where the width of the second trench 82 in the drain pan 8 is small.

Figure 11:
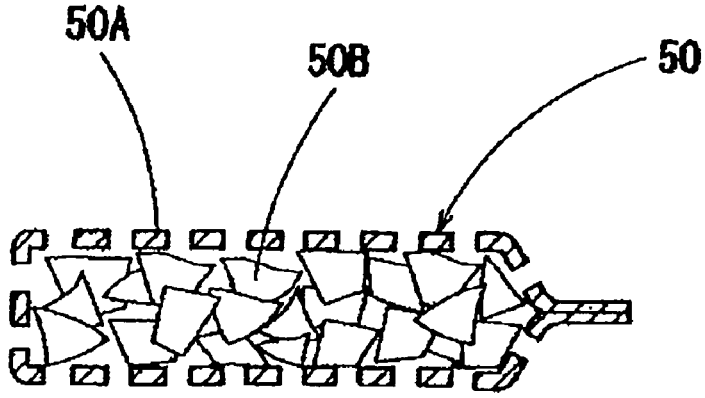
FIG. 11 is an enlarged cross-sectional view showing an antibacterial member according to another example of a configuration.

Furthermore, in this configuration, it is appropriate for the container main body 50A to be formed of, for example, a mesh member (made of a synthetic resin) having flexibility. In the case where the container main body 50A is formed of a mesh member, as shown in FIG. 11, one side and the two ends, upper and lower, of the mesh member are joined or sewn together in such a manner as to have a folded structure, and thus, the container main body 50A may be formed so as to be in the form of a flat bag.

Second Modification

Figure 12:
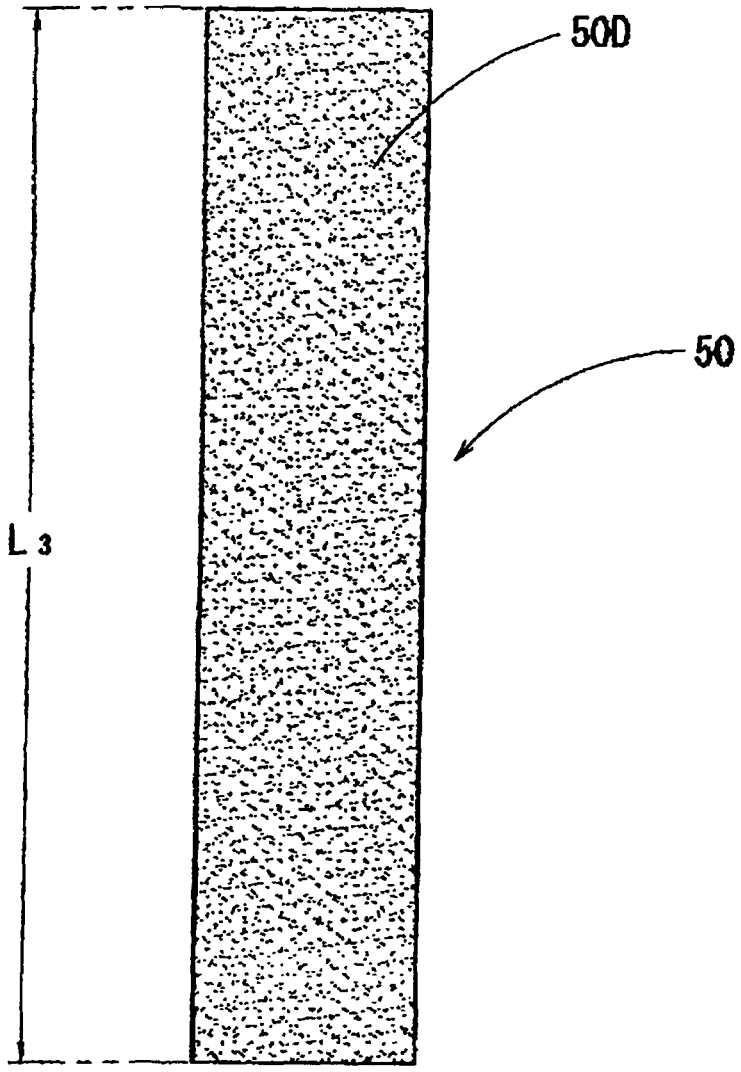
FIG. 12 is a plan view showing an antibacterial member according to a second modification.
Figure 13:
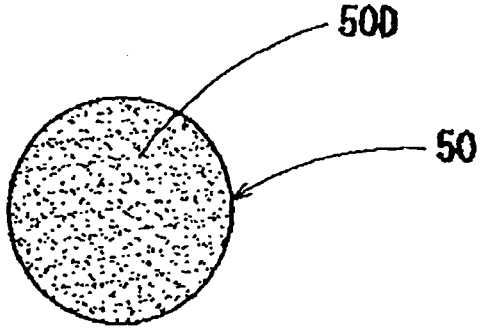
FIG. 13 is a plan view showing the antibacterial member.

A second modification is the same as the above described first embodiment, except that the above described antibacterial member 50 is formed so as to be in columnar form by uniformly kneading the antibacterial agent 50B in granular form or pellet form into a synthetic resin material 50D, which is an antibacterial agent holding material having water solubility, as shown in FIGS. 12 and 13.

In the case of this configuration, as the synthetic resin material 50D and the antibacterial agent 50B, which are located in the lower end portion of the antibacterial member, 50 dissolve, the antibacterial member 50 becomes shorter. The antibacterial member 50 is simply held by holding means in one form or another in such a manner that it can slide down from above, and thus, it is possible for stable antibacterial effects to be sustained over a long period of time, with the antibacterial agent maintaining a constant concentration, in approximately the same manner as in the above described case.

Second Embodiment

Figure 15:
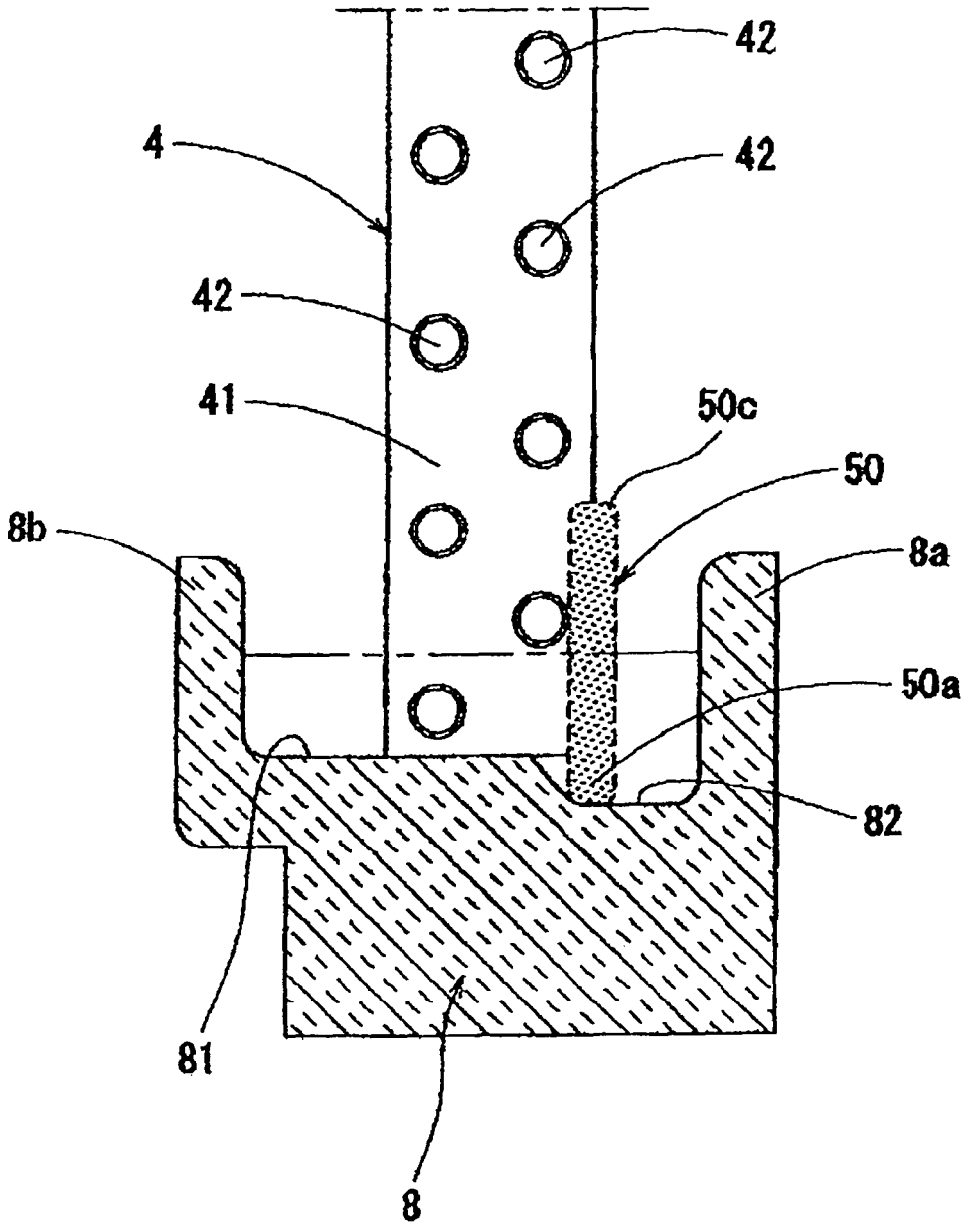
FIG. 15 is a cross-sectional view showing a drain water bacteriostatic structure of an air conditioner.
Figure 16:
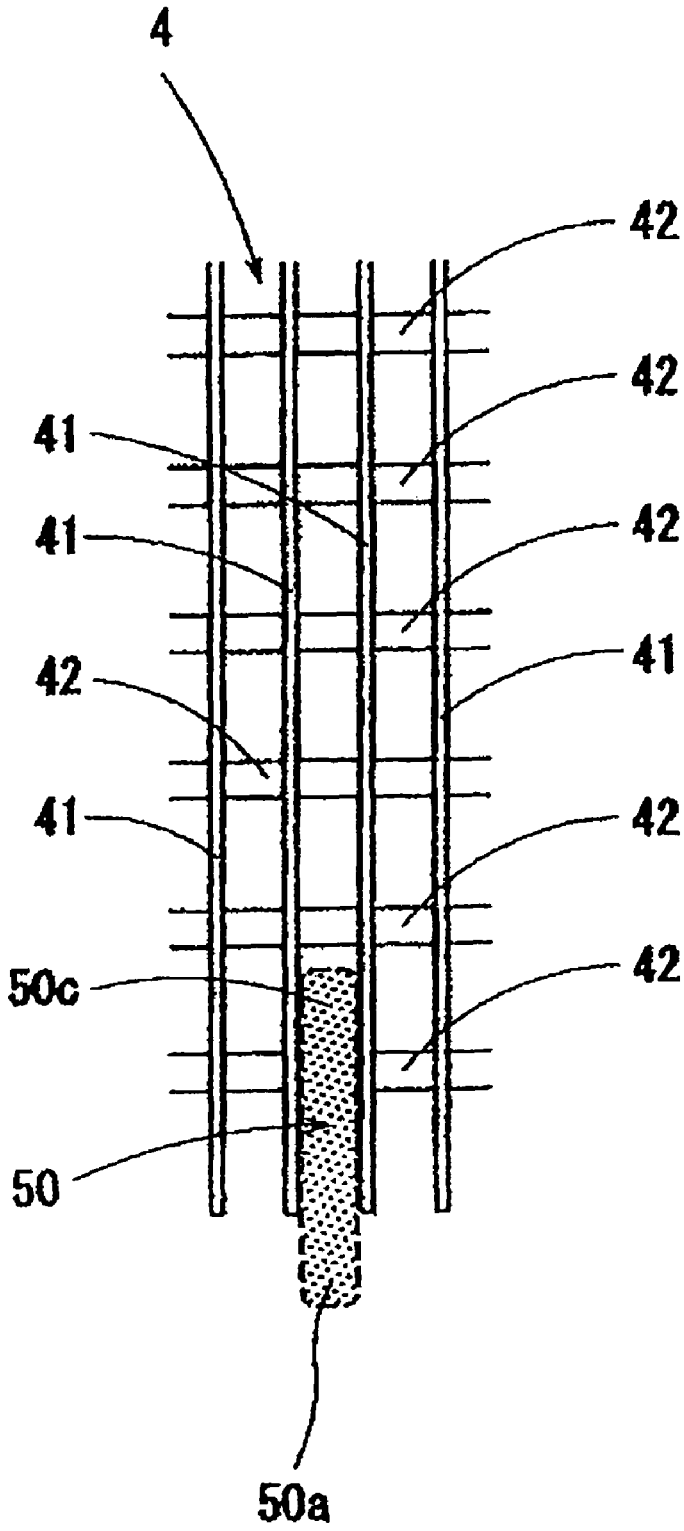
FIG. 16 is an enlarged front view showing a drain water bacteriostatic structure according to a second embodiment.

FIGS. 15 and 16 show a drain water bacteriostatic structure for an air conditioner according to a second embodiment of the present invention.

This embodiment is characterized in that the above described antibacterial member 50 is sandwiched between the respective plate fins 41 of the heat exchanger 4 so as to be secured in the space between these, and thus, the antibacterial member 50 is installed in the second trench 82 of the drain pan 8. The other parts of the configuration are all the same as in the first embodiment. In this configuration also, exactly the same advantages as in the first embodiment can be gained. In addition, in this case, no special attachment member or attachment structure is required, and thus, the cost is low.

Third Embodiment

Figure 17:
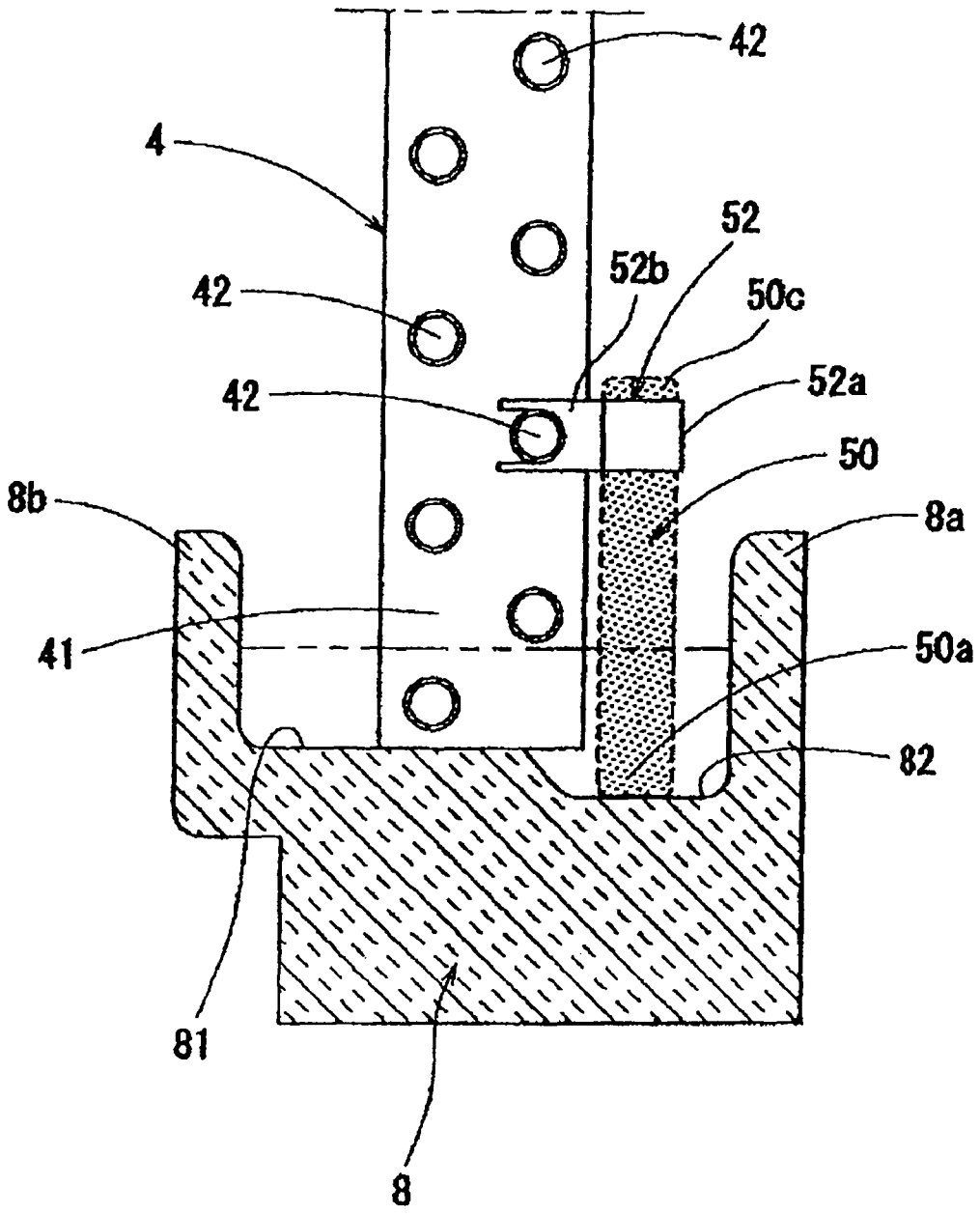
FIG. 17 is a cross-sectional view showing a drain water bacteriostatic structure for an air conditioner according to the third embodiment.
Figure 18:
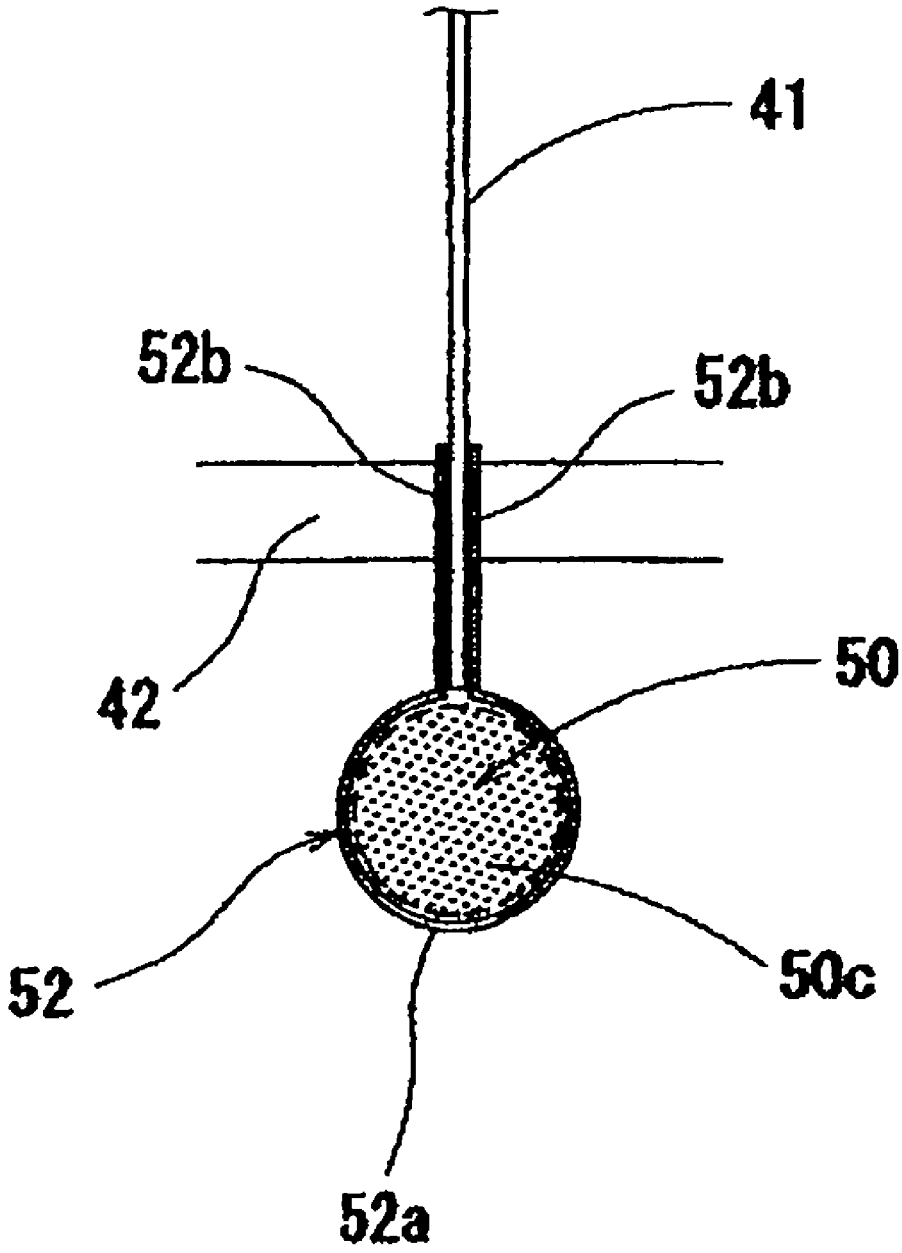
FIG. 18 is an enlarged plan view showing a drain water bacteriostatic structure for an air conditioner.

FIGS. 17 and 18 show a drain water bacteriostatic structure for an air conditioner according to a third embodiment of the present invention.

This embodiment is characterized in that the antibacterial member 50 according to the first embodiment is secured to a heat transfer pipe 42 which is located on the outer periphery side in each plate fin 41 of the heat exchanger 4 using an engaging member 52, and thus, the antibacterial member 50 is installed in the second trench 82 of the drain pan 8. The other parts of the configuration are all the same as in the first embodiment. In this configuration also, exactly the same advantages as in the case of the first embodiment can be gained.

In this case, the engaging member 52 is formed of a ring 52*a* which is in cylindrical form and extends in the up-down direction, and is in C shape with an opening facing the plate fin 41, and a pair of engaging pieces 52*b* and 52*c* which extend toward the plate fin 41 from the side wall of the ring 52*a*, as shown in FIGS. 17 and 18. The ring 52*a* is engaged with the container main body (50A in FIG. 6) of the antibacterial member 50 in cylindrical form. The respective engaging pieces 52*b* and 52*c* are in arm form and extend from portions of the ring 52*a* adjacent to the above described opening. A trench in U shape with an opening facing the plate fin 41 is created at the end of each engaging piece 52*b* and 52*c*. Therefore, the upper end portion 50*c* of the antibacterial member 50 is engaged with and held by the ring 52*a*, and after that, the trench in U shape of the two engaging pieces 52*b* and 52*c* is engaged with a heat transfer pipe 42 which is located on both sides of a predetermined plate fin 41, and thus, as shown in FIG. 17, the engaging member 52 can support the antibacterial member 50 in a simple manner. In this configuration, more secure support of the antibacterial member 50 is possible than in the case of the second embodiment.

Fourth Embodiment

Figure 19:
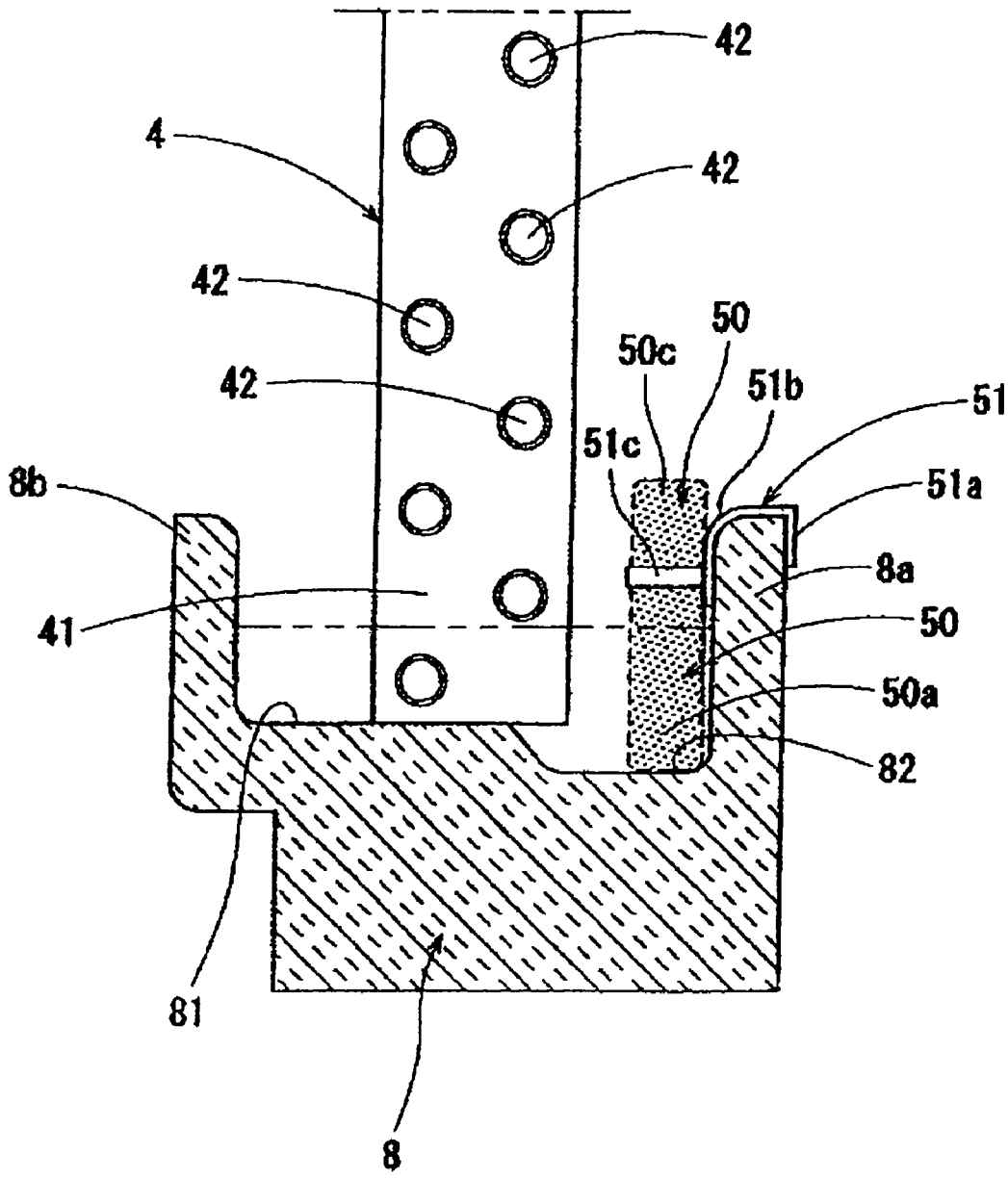
FIG. 19 is a cross-sectional view showing a drain water bacteriostatic structure for an air conditioner according to a fourth embodiment.
Figure 20:
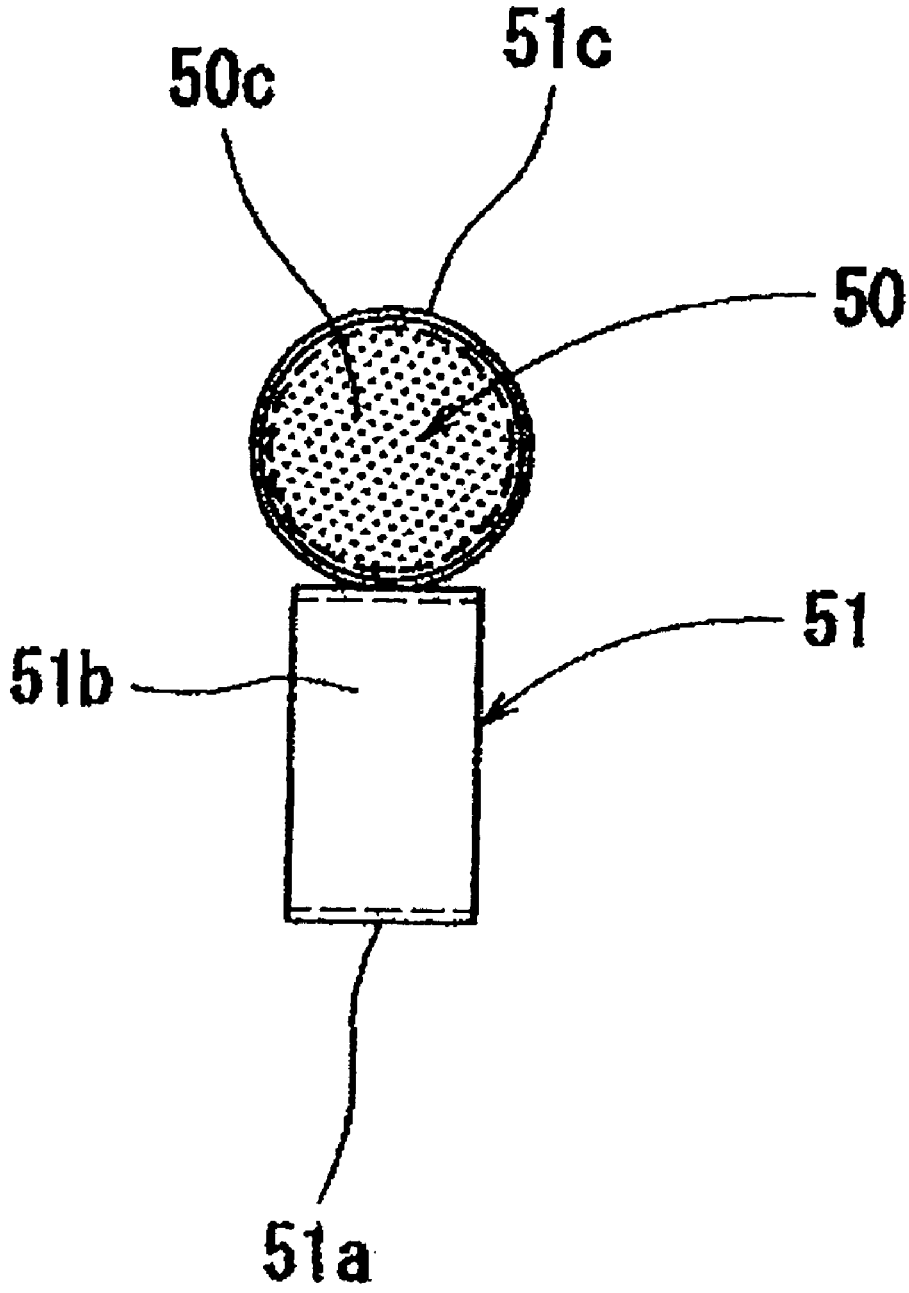
FIG. 20 is an enlarged plan view showing the drain water bacteriostatic structure for an air conditioner.

FIGS. 19 and 20 show a drain water bacteriostatic structure for an air conditioner according to a fourth embodiment of the present invention.

In the configurations according to the second and third embodiments, the antibacterial member 50 is installed in such a state as to make contact with each plate fin 41 of the heat exchanger 4, and therefore, the amount of draft between the respective plate fins 41 is reduced.

Therefore, the fourth embodiment is characterized in that the antibacterial member 50 according to the first embodiment is installed in such a state as to be in the vicinity of the side wall 8*a*, which is located on the outer peripheral side of the drain pan 8, using an engaging member 51, as shown in FIGS. 19 and 20, and thus, the amount of draft between the respective plate fins 41 can be prevented from being reduced. The engaging member 51 is formed of a ring 51*c* in annular form with which the upper end portion of the antibacterial member 50 is engaged and a hook 51*b* in reverse J shape which is linked to the outer peripheral surface of the ring 51*c* and has an engaging piece 51*a* which is engaged with the side wall 8*a* of the drain pan 8.

In this configuration, the engaging piece 51*a* of the hook 51*b* is engaged with the side wall 8*a* of the drain pan 8 in a simple manner, and thus, the antibacterial member 50 can be installed, and therefore, installation and replacement of the antibacterial member 50 are easy.

Fifth Embodiment

Figure 21:
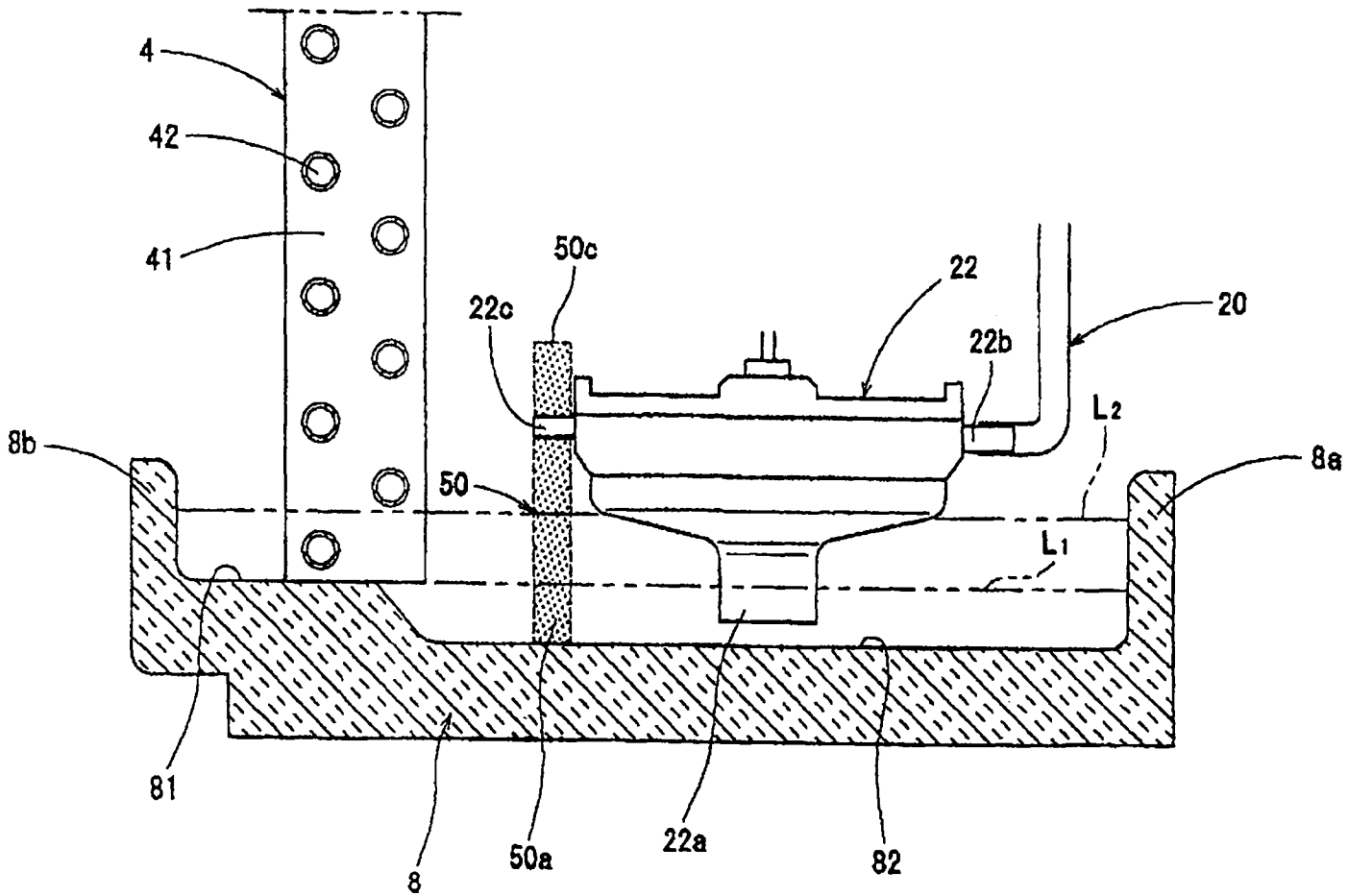
FIG. 21 is a cross-sectional view showing a drain water bacteriostatic structure for an air conditioner.

FIGS. 21 and 22 show a drain water bacteriostatic structure for an air conditioner according to a fifth embodiment of the present invention.

This embodiment is characterized in that the antibacterial member 50 is provided in a portion where the drain pump 22 is installed. This portion for installation is generally designated as maintenance space, and the antibacterial member 50 is easily subjected to appropriate vibration (microscopic vibration).

As shown in FIG. 21, the drain pump 22 is provided at a predetermined distance from the outer peripheral side of the heat exchanger 4, and the portion of the second trench 82 where the drain pump 22 is installed is formed so as to be wider than the other portions by a predetermined length. The drain pump 22 is placed in the second trench 82, so that the intake opening 22*a* draws in drain water. One end of a drain hose 20 is engaged with a drain water outlet 22*b* of the drain pump 22.

In the case of this embodiment, as shown in FIGS. 21 and 22, a pair of engaging pieces 22*c* are formed integrally with the pump casing at a predetermined distance from each other, on one side of the pump casing of the drain pump 22. The upper end portion 50*b* of the antibacterial member 50 is sandwiched and held between the engaging pieces 22*c* in such a manner as to be exposed above the maximum water level $L_2$ of drain water in the drain pan 8 by a predetermined length H.

In this configuration, installation of the antibacterial member 50 allows the same advantages as in the respective embodiments to be gained, and microscopic vibration when the drain pump 22 is driven makes it possible for new antibacterial agent 50B to be smoothly supplied from above into the space created as a result of depletion of the antibacterial agent 50B in the lower end portion 50*a*, and thus, more stable supply of the antibacterial agent 50B is possible.

In general, the above described antibacterial agent in granular form or pellet form is placed at random, and therefore, some means for smoothly supplying the antibacterial agent 50B into the above described space from above is necessary. In this embodiment, this means has excellent effects.

Furthermore, the portion where the drain pump 22 is installed is originally designated as maintenance space, and therefore, replacement of the antibacterial member 50 after years of use is easy.

Other Embodiments

(a) Concerning Air Conditioners to which Invention is Applied

Though in the examples in the above description, the present invention is applied to a ceiling embedded air conditioner, the bacteriostatic structure according to the present invention is effective for bacteriostasis for drain water in other types of air conditioners, for example, ceiling suspended air conditioners, wall type air conditioners and window type air conditioners. The air conditioners may or may not have a drain pump in a portion where the drain pan is installed.

A drain up kit having, for example, a drain pan, a drain pump, and a water level controlling mechanism, may be used as the drain pan and drain pump. Such a kit can be installed separately and used independently (in some cases, the electrical system may be linked) of the air conditioner main body 1, and drain water that flows in can be discharged independently. In the case where the range of lift is insufficient with the drain pump mounted in the product, this kit may be used.

Even in this case, the drain water bacteriostatic structure according to the present invention is effective.

(b) Concerning Antibacterial Agent

According to the respective embodiments, any organic antibacterial agent, inorganic antibacterial agent or mixture of these can be selected for use as the antibacterial agent. As organic antibacterial agents, phenols, haloalkyls, iodine compounds, benzimidazoles, thiocarbamates, heterocyclic nitrogen compounds, quinones, isothiazolines, quaternary ammonium salts, cyanates, and anilides, and in addition, compounds of which the main component is trichlorocarbanide, polyhexamethylene biguanide hydrochloride and octadecyl dimethyl-3-trimethoxysilyl propyl ammonium may be used.

In addition, as inorganic antibacterial agents, inorganic antibacterial agents of which the main component is an inorganic compound, such as silver, copper, zinc or tin, and inorganic antibacterial agents where any of these antibacterial agents are carried by calcium carbonate, zeolite, kaolin clay, diatomaceous earth, talc, bentonite, ceramics, activated charcoal or apatite may be used.

Figure 14:
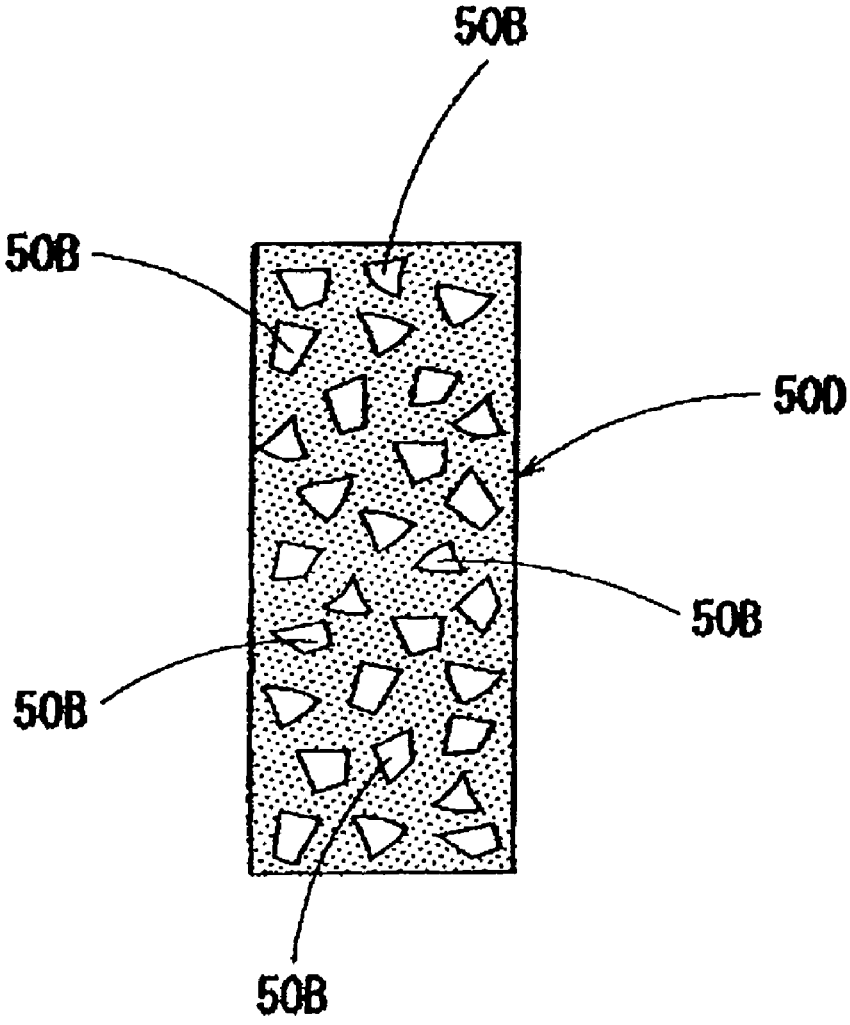
FIG. 14 is an enlarged cross-sectional view showing an antibacterial member.

Inorganic antibacterial agents carried by ceramics, activated charcoal, apatite or the like have advantages, such that the antibacterial properties are excellent, and they are nonvolatile and can be easily kneaded in with a resin. Accordingly, these are appropriate for the antibacterial member 50 according to the above described second modification (FIGS. 12 to 14).

The value of products using the antibacterial agent-containing resin composite containing the synthetic resin material 50D and the antibacterial agent 50B according to the second modification can be increased when an additive, such as a deodorant or a scenting agent is added and mixed in if necessary, within such a scope that the object of the present invention is not deviated from.

In addition, it is also possible to adopt an antibacterial agent in granular form or having a pellet structure which dissolves in water in such a manner that the antibacterial agent having pasteurizing effects is gradually eluted, such as water soluble glass carrying an inorganic antibacterial agent as described above, as the antibacterial agent 50B in granular form or pellet form having such properties as to dissolve in water, as described above.

The invention claimed is:

1. A drain water bacteriostatic structure for an air conditioner, comprising:

a drain pan for holding drain water generated in an air conditioner; and an upright antibacterial member which is provided in the drain pan, wherein said antibacterial member has an antibacterial agent and the length $L_3$ of said antibacterial member in the up-down direction is set such that a lower end portion of the antibacterial member is immersed in drain water when drain water is at the minimum water level $L_1$ in the drain pan, and an upper end portion of the antibacterial member is exposed above the maximum water level $L_2$ of drain water in the drain pan by a predetermined length H or more, wherein the antibacterial member is held in such a manner that it can slide down from above, said antibacterial member is formed of a mixture of a holding material having water solubility and an antibacterial agent having water solubility in granular form or pellet form, and when the antibacterial agent, which is submerged in drain water in a lower end portion of the antibacterial member, is eluted in the drain water and reduced, the antibacterial agent, which is located above the actual water level of the drain water and not eluted, moves down from above in response so as to be supplied in sequence.

2. The drain water bacteriostatic structure for an air conditioner according to claim 1, further comprising a drain pump, wherein the antibacterial member is provided in a portion where the drain pump is installed.

3. The drain water bacteriostatic structure for an air conditioner according to claim 1, wherein the antibacterial member is formed to be in columnar form.

4. The drain water bacteriostatic structure for an air conditioner according to claim 3, wherein the columnar form is formed by uniformly kneading the mixture of the holding material and the antibacterial agent into a synthetic resin material.

* * * * *